United States Patent [19]

Kammerer et al.

[11] 4,251,162

[45] Feb. 17, 1981

[54] FORM BAND ALIGNMENT DEVICE FOR A FORM PRINTER

[75] Inventors: Heinrich Kammerer, Königsfeld; Heinz Niess, St. Georgen; Walter Schunggart; Ruprecht Flügge, both of Villingen; Hermann Kilb, Brigachtal, all of Fed. Rep. of Germany

[73] Assignee: Kienzle Apparate GmbH, Villingen, Fed. Rep. of Germany

[21] Appl. No.: 891,349

[22] Filed: Mar. 29, 1978

[30] Foreign Application Priority Data

Apr. 20, 1977 [DE] Fed. Rep. of Germany ..... 2717407
Mar. 1, 1978 [DE] Fed. Rep. of Germany ..... 2808678

[51] Int. Cl.[3] ..... B41J 15/00

[52] U.S. Cl. ..... 400/613.1; 400/610.3; 400/616.3; 400/619; 400/631; 400/632; 400/708; 226/76; 226/89; 226/91

[58] Field of Search ..... 400/579, 600, 600.1, 400/600.2, 600.3, 600.4, 610.2, 610.3, 610.4, 616, 616.1, 616.2, 616.3, 619, 621.2, 630, 631, 632, 632.1, 708, 613.1; 226/27, 34, 35, 52, 74, 76, 82, 83, 89, 90, 91, 92

[56] References Cited

U.S. PATENT DOCUMENTS

| | | | |
|---|---|---|---|
| 1,326,306 | 12/1919 | Thomas | 400/600.1 X |
| 2,156,315 | 5/1939 | Sherman et al. | 400/632.1 X |
| 2,809,830 | 10/1957 | Becker | 226/90 |
| 2,879,993 | 3/1959 | Scozzafava et al. | 226/91 X |
| 3,288,264 | 11/1966 | Gabrielson et al. | 400/619 |
| 3,292,763 | 12/1966 | Whitehead | 400/616 X |
| 3,430,748 | 3/1969 | Parri | 400/708 X |
| 3,548,746 | 12/1970 | Hepp | 400/619 X |
| 3,656,602 | 4/1972 | Konkel et al. | 226/83 X |
| 3,730,082 | 5/1973 | Perry | 400/616.1 |
| 3,979,036 | 9/1976 | Vorbach et al. | 226/89 X |

*Primary Examiner*—Ernest T. Wright, Jr.
*Attorney, Agent, or Firm*—Toren, McGeady and Stanger

[57] ABSTRACT

A perforated form band is introduced into a form printer through an input passage or shaft. The passage is formed by spaced walls and is pivotally mounted on the printer for movement between an input position and a working position. In the input position, a form band is introduced into and aligned within the input passage. In one embodiment, the leading end of the form band contacts transversely extending stop surfaces, while in another the leading end of the form band is aligned with an indicating mark and the perforations on the form band engage with projections in the input passage. With the form band aligned, the input passage is moved into the working position engaging the perforations in the form band on pins projecting outwardly from sprocket wheels which drive the form band through the printer. In the working position of the input passage, the form band no longer contacts the stop surfaces or engages the projections used in the aligning operation.

11 Claims, 4 Drawing Figures

FORM BAND ALIGNMENT DEVICE FOR A FORM PRINTER

SUMMARY OF THE INVENTION

The present invention is directed to form printers, and, more particularly, to a device used in form printers for introducing and aligning a perforated form band to be driven through the printer by a sprocket member.

From general experience it has been noticed that the problem of introducing a perforated endless form band into a printer is not as easy as it first appears. Since the form bands are relatively wide, the human eye cannot recognize at a first viewing which holes on the opposite sides of the form band are located on the opposite ends of a line parallel to the leading edge of the band. It frequently happens when a form band is introduced that the sprockets on one side of sprocket wheels or a driving member engage the fourth hole counted from the leading end of the band while on the opposite side the sprockets engage the fifth hole. When the form is clamped and the driving means switched on, it can be noted shortly after start up that the form is skewed. As a consequence, the entire process of introducing the form must be repeated, since the form transport device cannot function properly if the form band has been incorrectly introduced.

Another problem which has been experienced is that the form bands very often include several superimposed layers with a considerable thickness of the form bands being involved, since there is air between the layers which adds to the difficulties in initially introducing the form band before commencing the printing operation.

It is the primary object of the present invention to overcome the disadvantages previously experienced by simplifying the process of introducing perforated form bands into a printing device. In accordance with the present invention, an input shaft or passage is pivotally mounted between an input position where it is pivoted out of engagement with a sprocket device and a working position where the perforated form band engages the sprocket device. Aligning means are associated with the input passage for aligning the form band normal to the input direction. The aligning means are in positive connection with the input passage so that they are effective in the input position and ineffective in the working position.

In accordance with the present invention, the form transport device includes a pivotal input passage for guiding the form band laterally and the passage includes pivotal aligning means permitting the form band to be introduced into the input passage in its input position until the band is properly aligned and then to pivot the input passage so that the form band is automatically aligned on the sprocket device, the pins or sprockets having been previously adjusted to a starting position. When the form band is introduced and aligned, the input passage is positioned so that the pins on the sprocket device do not interfere with this process.

Since the form band is to be introduced manually, the input passage is designed to be pivoted manually so that the alignment means, by a positive connection to the input passage, are displaced into the effective position.

Different embodiments of the invention are available. In one embodiment, the alignment means include stop surfaces limiting a movement of the form band through the input passage in its input position with the stop surfaces extending transversely to the direction in which the band is introduced through the input passage. The stop surfaces are located downstream from the location of the sprocket device in the input passage. When the input shaft is pivoted into its working position, the stop surfaces are pivoted to an ineffective position.

In another embodiment, the alignment means include projections located in the input passage spaced apart at a distance corresponding to the spacing between the opposite rows of perforations along the edges of the form band. In this embodiment, the projections are located within the input passage in the path of the form band before it reaches the sprocket device.

The various features of novelty which characterize the invention are pointed out with particularity in the claims annexed to and forming a part of this disclosure. For a better understanding of the invention, its operating advantages and specific objects attained by its use, reference should be had to the accompanying drawing and descriptive matter in which there are illustrated and described preferred embodiments of the invention.

DETAILED DESCRIPTION OF THE INVENTION

Figure 1:
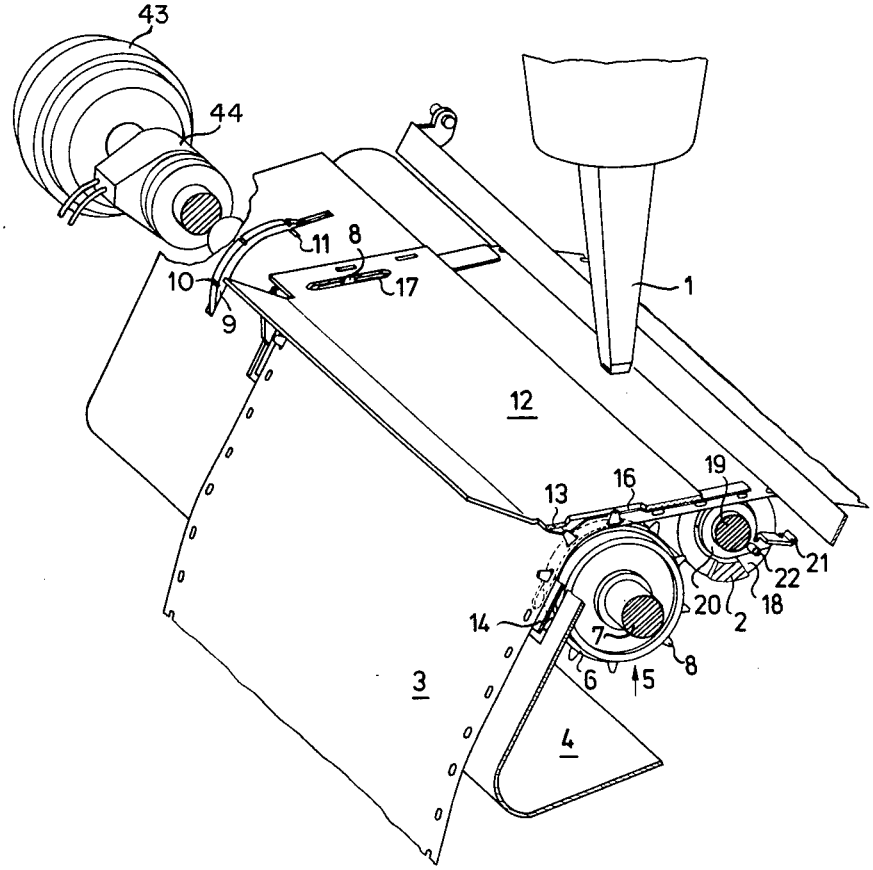
FIG. 1 is a perspective view of a printer with a form transport device illustrating one embodiment of the present invention.

In FIG. 1 a needle printer 1 is positioned above and cooperates with a fixed printing support 2 in the form of a roller. The needle printer 1 is movable across the surface of the roller 2 for printing, thereby producing its printing points. It can be appreciated that instead of the needle printer 1 other printing devices can be used.

As viewed in FIG. 1, a form band 3 is guided from the left to the right over a guide plate 4 into the printer. Form band 3 is perforated along both longitudinal edges and is driven through the printer by a sprocket device 5 including, as viewed in FIG. 1, a right-hand pinwheel 6 and a left-hand pinwheel represented only by pins 8. The sprocket device 5 is rotatably mounted on a shaft 7 and a motor 43 and clutch 44 provide the selective engagement of the sprocket device 5 to the shaft 7 for driving the form band 3 over the roller 2. A hand wheel 9 is connected to the sprocket device 5 and the wheel 9 has markings 10 spaced apart at a distance corresponding to the spacing between printing lines. On the guide plate 4, through which the hand wheel 9 projects, there is an alignment marking 11 which permits, by turning the sprocket device 5 via the hand wheel 9, to align the pins 8 extending radially outwardly from the pin wheels 6 to afford a correct initial position of the wheels 6 before the motor is engaged with them. For introducing a form band 3, an input shaft or passage 12 is provided including an upper guide plate 13 and a lower guide plate 14 connected together by lateral wall parts 15', note FIG. 2. The guide plates 13 and 14 are spaced apart and form a mouth 15 on the front side of the printer through which the form band 3 is introduced. Cut-outs 16, 17 are located along the opposite edges of the guide plates 13, 14 so that the pins 8 on the sprocket device 5 can extend through the input passage 12. At its forward end, the upper guide plate 13 of the input passage 12 has an upwardly turned edge which serves as a handle for pivoting the input passage 12.

Figure 2:
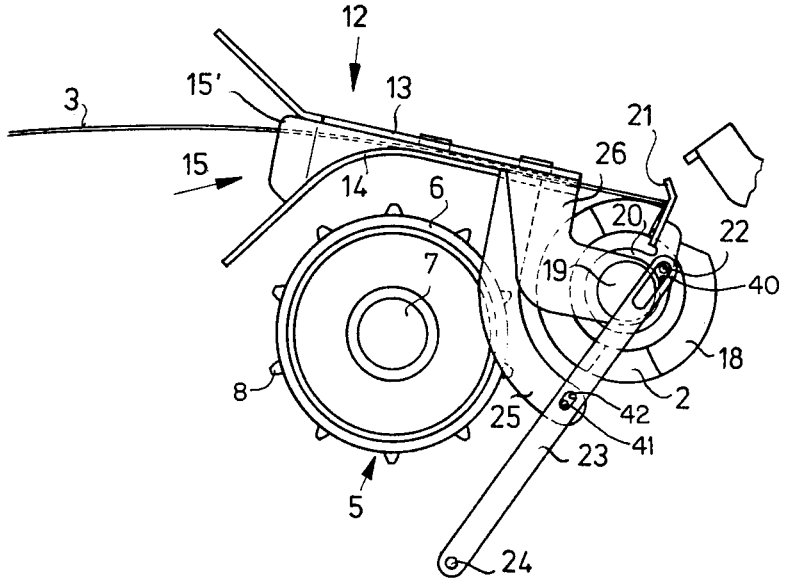
FIG. 2 is a side view of the embodiment shown in FIG. 1.

Two recesses 18 are provided in the printing support 2 spaced apart along its axis. Each recess 18 contains a stop lever 20 mounted on the bearing shaft 19 for the printing support 2. Each stop lever 20 has a stop surface 21. The stop surfaces 21 provide the alignment means in the present invention. Stop levers 20 are connected to one another by a bar 22. As can be seen in FIG. 2, a lever 23 is linked to the bar 22, that is, the bar 22 is movably guided within an elongated slot 40 in one end of the lever 23. The opposite end of the lever 23 from bar 22 is mounted on a fixed bolt 24. Intermediate its ends, the lever 23 is connected by a pin 41 and slot 42 connection to another lever 25 attached at its opposite end spaced from the lever 23 to the input passage 12. The input passage 12 is pivotally mounted on bearing shaft 19 of the printing support 2 by means of a pair of angle levers 26.

This device works in the following manner: As long as no form band 3 has been inserted into the printer, the motor is normally turned off and the clutch 44 driving the sprocket device 5 is disengaged. In this position, the sprocket device 5 can be adjusted by means of the hand wheel 9 by aligning one of its markings 10 with the marking 11 on the printer housing. As a result, the pins 8 on the two pin wheels 6 are in the correct position to take up the form band 3. The input passage 12 is pivoted by means of its upper guide plate 13 to the upper or input position, as shown in FIG. 2. As a result of this pivoting movement, the levers 23, 25 and the stop levers 20 are displaced from their ineffective positions as shown in FIG. 1 to their effective positions as shown in FIG. 2. A new form band 3 can be introduced into the printer. It can be noted in FIG. 2 that the pin wheels 6 are displaced out of the input passage 12. Within the input passage 12, the upper and lower guide plates 13, 14 as well as the lateral wall parts 15' guide the form band 3 until its leading end is aligned by contacting the stop surfaces 21 located on the printing support 2. When the input passage 12 is pivoted from the input position as shown in FIG. 2 to the working position shown in FIG. 1, the perforations along the edges of the form band 3 are introduced onto the pins 8 of the pin wheels 6. The form band 3 is properly aligned and can be moved to any desired line position if it is not intended to commence printing on the first line. When the input passage 12 is pivoted from the input position of FIG. 2 to the working position of FIG. 1, the stop surfaces 21 are moved to their ineffective positions.

Figure 4:
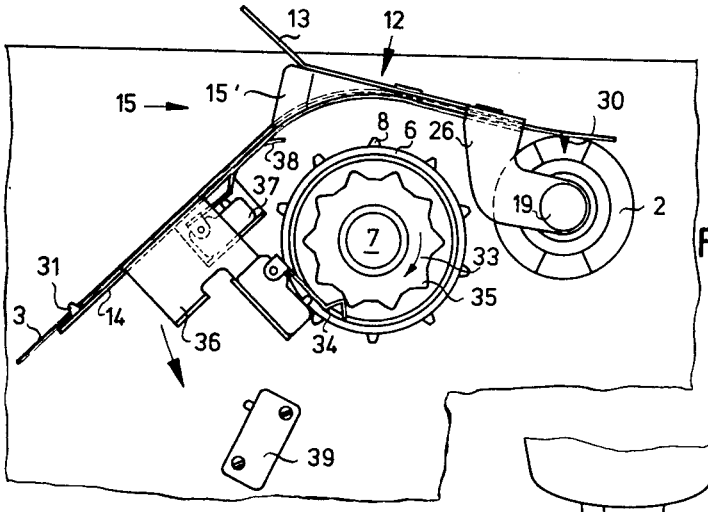
FIG. 4 is an end view of the device shown in FIG. 3.
Figure 3:
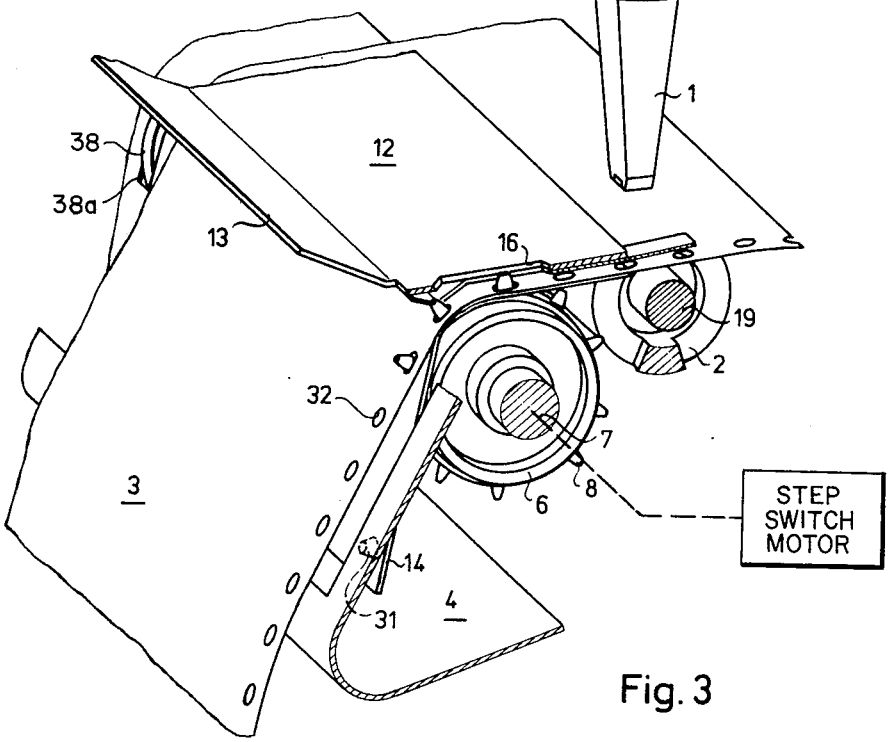
FIG. 3 is a partial perspective view of another embodiment of the present invention.

In FIGS. 3 and 4, another embodiment of the invention is illustrated in which parts similar to the embodiment in FIGS. 1 and 2 have the same reference numerals. In FIGS. 1 and 2, the aligning means for the leading end of the form band 3 are represented by stop surfaces 21 arranged within the input passage 12 but downstream from the sprocket transport device formed by the pin wheels 6. When the input passage 12 is displaced from the input position to the working position, the stop surfaces 21 are moved into an ineffective position. In the embodiment in FIGS. 3 and 4, the stop surfaces 21 have been replaced by a marking 30 on the printing support 2 or adjacent the printing support 2, which marking 30 appears as a line extending along the axial direction of the roller forming the printing support 2. Instead of the marking 30, it would be possible to use an alignment bar which can also be used as a guide means for the form band 3. Additionally, the lower guide plate 14 of the input passage 12 is provided with projections 31 each located on an opposite side of the input passage 12 spaced apart at the same distances as the lines of perforations along the opposite sides of the form band 3 so that one hole 32 along each side can fit over the projections 31. In this embodiment the pin wheels 6 are no longer adjusted manually. Rather, adjustment is effected automatically by a motor when the form band 3 is inserted into the input passage 12. In this embodiment, a step switch motor drives the shaft 7 and also the pin wheels 6 in a step-by-step manner. An adjustment wheel 33 is fixed on the shaft 7 and cooperates with a first switch 34. Each time one of the teeth 35 on the adjustment wheel 33 contacts the first switch 34 it causes the switch 34 to be actuated. It should be mentioned at this point that the step switch motor drives the shaft 7 in many small steps so that a plurality of the steps always represents one line.

First switch 34 is mounted on an arm 36 located on the lower guide plate 14 of the input passage 12. Positioned on the same arm 36 is a second switch 37 which includes a switching lever 38 projecting through an opening **38*a* in the lower guide plate 14 into the input passage 12. As soon as a form band 3 is manually inserted into the input passage 12, the switching lever 38 is pivoted and the second switch 37 is closed. Accordingly, the step switch motor is turned on and the shaft 7 is moved in a stepwise manner. As soon as one of the teeth 35, there is a corresponding number of teeth and pins 8, contacts the switch 34, the motor is turned off again. This process operates automatically while the form band 3** is being inserted and does not require the attention of the operator.

In the embodiment illustrated in FIGS. 3 and 4, the person operating the printer introduces the form band 3 into the input passage 12 with the form band 3 being guided not only by the upper and lower guide plates 13, 14 but also by the lateral wall parts 15'. The form band 3 is inserted manually until its leading edge is visually aligned with the marking 30. The form band 3 is then placed on the lower guide plate 14 with two of its perforations 32 fitted onto the projections 31. The form band 3 is now inserted and aligned. Manually pivoting the input passage 12 downwardly by pressing on the upper guide plate 13, the input passage 12 is moved downwardly pivoting about the bearing axle 19. As a result of this downward movement, the form band 3 is automatically engaged with the pins 8 on the pin wheels 6 so that it is aligned for the printing process. As the input passage 12 is pivoted downwardly, the lower guide plate 14 releases the form band 3, since the projections 31 are displaced out of engagement with the perforations 32, note FIG. 3. At the same time, the first switch 34 is moved out of engagement with the adjustment wheel 33 and another switch 39 is closed providing a signal that the aligning process has been concluded and that the printing process can be commenced.

By considering the two embodiments of the present invention, one disclosed in FIGS. 1 and 2 and the other in FIGS. 3 and 4, it can be appreciated that with a minimum of manual operations the form band 3 can be inserted and aligned in a manner which avoids any kind of skewing of the form band 3. Further, it is possible to start printing on the leading end of the form band 3 which has been inserted without experiencing any loss of paper.

While specific embodiments of the invention have been shown and described in detail to illustrate the application of the inventive principles, it will be understood that the invention may be embodied otherwise without departing from such principles.

What is claimed:

1. In a form printer including a sprocket member for driving a perforated form band through the printer, the improvement comprising a device for aligning the perforated form band as the form band is introduced into the form printer, said device comprising an input passage means for introducing the form band into the printer pivotally mounted on the printer for movement between an input position for introducing the form band, and in the input position said input passage means being disposed out of engagement with said sprocket member, and a working position in which the perforated form band located within said input passage means is placed into engagement with said sprocket member, said input passage means having a first end through which the form band is introduced into the form printer and a second end spaced from the first end in the direction in which the form band moves from the first end into the printer, said sprocket member engaging the perforated band within said input passage means at a location intermediate the first and second ends thereof when said input passage means is in the working position, and further comprising aligning means for aligning the form band in a direction extending substantially normal to the direction in which the form band is introduced into said input passage means, said aligning means being positively connected to said input passage means for location in an effective position when said input passage means is in the input position and for loction in an ineffective position when said input passage means is in the working position.

2. In a form printer, as set forth in claim 1, said aligning means including stop means having a stop surface extending substantially normal to the direction in which the form band is introduced through said input passage means and located spaced from the location in said input passage means in which the perforated form band engages said sprocket member toward the second end of said input passage means and mechanical linkages pivotally interconnecting said stop means to said input passage means.

3. In a form printer, as set forth in claim 2, including a printing support having recesses formed therein, said stop means being located in each of said recesses and said stop means being displaceable between the effective position and the ineffective position.

4. In a form printer, as set forth in claim 1, wherein said aligning means including projections located on said input passage means and positioned therein for engagement with the perforations in the form band, said projections located between said first end of said inlet passage means and the intermediate location therein where the form band contacts said sprocket member when said input passage means is in the working position, said printer including a printing support adjacent the second end of said input passage means and an alignment element providing an alignment mark extending normal to the direction of movement of the form band through said input passage means for aligning the leading end of the form band.

5. In a form printer, as set forth in claim 1, wherein said sprocket member comprises a pair of sprocket wheels spaced apart in the direction extending transversely of the direction of movement of the form band through said input passage means.

6. In a form printer, as set forth in claim 5, wherein said form printer includes a housing having an indicating mark thereon, a hand wheel located within said housing and connected to said sprocket wheels for rotating said sprocket wheels and being manually adjustable for turning said hand wheel relative to the indicating mark on said housing and for positioning said sprocket wheels.

7. In a form pinter, as set forth in claim 1, wherein said sprocket member comprises a pair of rotatable sprocket wheels spaced apart in the direction extending transversely of the direction of movement of the form band through said input passage means, a step switch motor in driving connection with said sprocket wheels, said sprocket member including an adjustment wheel arranged to rotate with said sprocket wheels.

8. In a form printer, as set forth in claim 7, wherein a first switch is positioned in said input passage means in the path of a form band moving therethrough, said first switch arranged to be operated by the form band, a second switch cooperating with said adjustment wheel when said input passage means is in the input position, and said first and second switches controlling said motor for adjusting said sprocket wheels.

9. In a form printer, as set forth in claim 1, wherein said input passage means comprises an upper guide plate, a lower guide plate, spaced downwardly from said upper guide plate, lateral wall parts interconnecting said upper and lower guide plates, and said upper guide plate, lower guide plate, and lateral wall parts defining an input passage defined by said input passage means.

10. In a form printer, as set forth in claim 1, including a roller forming a printing support, a bearing shaft for said roller, said input passage means being pivotally mounted on said bearing shaft.

11. In a form printer, as set forth in claim 9, wherein said sprocket member comprises a pair of sprocket wheels spaced apart in the direction extending transversely of the direction of the movement of the form band through said input passage means, said sprocket wheels having angularly spaced radially outwardly extending pins thereon, said upper and lower guide plates having cut-outs therein so that said pins on said sprocket wheels extend through said input passage means.

* * * * *